US005143040A

United States Patent [19]

Okawa et al.

[11] Patent Number: 5,143,040

[45] Date of Patent: Sep. 1, 1992

[54] EVAPORATIVE FUEL CONTROL APPARATUS OF INTERNAL COMBUSTION ENGINE

[75] Inventors: Koji Okawa; Kazuhiko Norota; Hiroyuki Mizuno, all of Toyota, Japan

[73] Assignee: Toyota Jidosha Kabushiki Kaisha, Toyota, Japan

[21] Appl. No.: 741,646

[22] Filed: Aug. 7, 1991

[30] Foreign Application Priority Data

Aug. 8, 1990 [JP] Japan ..... 2-211260
Aug. 31, 1990 [JP] Japan ..... 2-232046

[51] Int. Cl.[5] ..... F02D 41/14

[52] U.S. Cl. ..... 123/684; 123/520; 123/698

[58] Field of Search ..... 123/489, 520, 416, 415, 123/408, 568

[56] References Cited

U.S. PATENT DOCUMENTS

| | | | |
|---|---|---|---|
| 3,680,318 | 8/1972 | Hakajima et al. | 123/519 |
| 3,872,848 | 3/1975 | King | 123/520 |
| 4,748,959 | 6/1988 | Cook et al. | 123/489 |
| 4,771,752 | 9/1988 | Nishimura et al. | 123/489 |
| 4,841,940 | 6/1989 | Uranishi et al. | 123/520 |
| 4,967,713 | 11/1990 | Kojima | 123/489 |
| 5,048,493 | 9/1991 | Orzal et al. | 123/489 |
| 5,054,454 | 10/1991 | Hamburg | 123/520 |
| 5,060,621 | 10/1991 | Cook et al. | 123/520 |
| 5,067,469 | 11/1991 | Hamburg | 123/520 |
| 5,072,712 | 12/1991 | Steinbranno et al. | 123/520 |
| 5,085,194 | 2/1992 | Kuroda et al. | 123/479 X |

FOREIGN PATENT DOCUMENTS

| | | | |
|---|---|---|---|
| 8458 | 1/1985 | Japan | 123/520 |
| 18175 | 1/1988 | Japan | 123/520 |
| 55357 | 3/1988 | Japan | 123/520 |
| 57841 | 3/1988 | Japan | 123/520 |
| 85249 | 4/1988 | Japan | 123/520 |
| 289243 | 11/1988 | Japan | 123/520 |
| 3258 | 1/1989 | Japan | 123/520 |
| 19631 | 1/1990 | Japan | 123/520 |

*Primary Examiner*—Raymond A. Nelli
*Attorney, Agent, or Firm*—Kenyon & Kenyon

[57] ABSTRACT

An evaporative fuel control apparatus of an internal combustion engine for controlling a purge correction amount and a fuel injection amount in response to a concentration of fuel vapor in intake mixture. The apparatus includes a detection part for detecting operating conditions of the engine and for supplying signals indicative of the operating conditions, a purge valve for controlling a flow of fuel vapor from a fuel tank to an intake passage, and a calculation part for calculating the fuel injection amount in response to the signals. The apparatus also includes a first injection control part for varying a feedback correction factor of an air-fuel ratio in response to the signals so as to maintain the air-fuel ratio at a stoichiometric value, and for correcting the fuel injection amount with the feedback correction factor, a second injection control part for correcting the fuel injection amount in response to the fuel vapor concentration which is determined from the varied feedback correction factor, and a purge correction part for correcting a purging amount of fuel vapor being fed by the purge valve to the intake passage in response to the fuel vapor concentration.

15 Claims, 11 Drawing Sheets

| FAF | DPG | KPG |
|---|---|---|
| KFAFH< FAF | INCREASE | DECREASE |
| 1·0 ≦FAF≦KFAFH | INCREASE | NO CHANGE |
| KFAFL≦FAF<1·0 | NO CHANGE | INCREASE |
| KFAFL> FAF | DECREASE | INCREASE |

| | FAF | DPG | KPG |
|---|---|---|---|
| 1ST RANGE | 1.05 < FAF | KPG= 0 : 0 | DPG< e : 0 |
| | | KPG≠ 0 : DECREASE | DPG≧ e: DECREASE |
| 2ND RANGE | 1.0≦FAF ≦ 1.05 | INCREASE | NO CHANGE |
| 3RD RANGE | 0.95 < FAF< 1.0 | NO CHANGE | INCREASE |
| 4TH RANGE | 0.95 ≧ FAF | DECREASE | INCREASE |

EVAPORATIVE FUEL CONTROL APPARATUS OF INTERNAL COMBUSTION ENGINE

BACKGROUND OF THE INVENTION (1) Field of the Invention

The present invention generally relates to evaporative fuel control apparatus, and more particularly to an evaporative fuel control apparatus of an internal combustion engine for feeding fuel vapor from a fuel tank to an intake system through a purge passage in which a purge control valve is provided.

(2) Description of the Related Art

Conventionally, in an internal combustion engine, an evaporative fuel control apparatus is known, which stores fuel vapor from a fuel tank in activated carbon in a canister and feeds the stored fuel vapor from the canister into an intake system of the internal combustion engine. The feeding of fuel vapor into the intake system is called hereinafter the purging of fuel vapor. Also, there is a known internal combustion engine which has a fuel injection control part performing a feedback control to control the air-fuel ratio of the air fuel mixture fed back from the internal combustion engine to converge toward the stoichiometric air-fuel ratio. For example, Japanese Laid-Open Patent Application No. 63-289243 discloses a prior fuel injection control apparatus which corrects, during the purging of fuel vapor, the amount of fuel being injected to a combustion chamber, in addition to performing the feedback control of the air-fuel ratio described above. The amount of the correction to correct the amount of fuel injected is determined in response to the concentration of fuel vapor in the intake mixture. The concentration of fuel vapor is calculated from the average of a feedback correction factor FAF with respect to the air-fuel ratio. The correction of the amount of fuel injected which is made by the fuel injection control apparatus owing to the amount of fuel vapor purged allows accurate follow-up control of the air-fuel ratio. A description of the feedback correction factor FAF is disclosed, for example, in the U.S. Pat. No. 4,841,940 assigned to the same assignee as the present invention, and the disclosure of this patent regarding the term "feedback correction factor" is hereby incorporated in this specification for clarity.

In the case of the prior fuel injection control apparatus described above, when the concentration of fuel vapor in the intake mixture is high, the amount of the correction due to the fuel vapor purging relative to the amount of fuel injected becomes too great, and accordingly the amount of fuel injected after the fuel vapor purging becomes too small. However, the minimum level of the amount of fuel injected into a combustion chamber of the internal combustion engine is predetermined, that is, the amount of fuel injected has to be invariably higher than such a lower limit of the fuel injection amount. The fuel injection amount hereinafter means the amount of fuel which is fed by a fuel injector into a combustion chamber of the internal combustion engine. Thus, the prior fuel control apparatus has a problem in that when the fuel vapor concentration is extremely high, the amount of the correction to correct the fuel injection amount due to the fuel vapor purging is not accurately controlled, thereby the fuel injection amount is sometimes lower than the predetermined minimum level and the air-fuel ratio is not appropriate for the internal combustion engine.

One solution to the above mentioned problem is an evaporative fuel control apparatus of an internal combustion engine in which both the amount of fuel injected and the amount of fuel vapor purged are suitably corrected in response to the concentration of fuel vapor, so that the air-fuel ratio is maintained at the stoichiometric air-fuel ratio invariably, even when the concentration of fuel vapor is very high. Therefore, one aspect of the present invention is directed to an evaporative fuel control apparatus of an internal combustion engine having such a correction capability.

In the case of the evaporative fuel control apparatus having the above mentioned correction capability, an intake air pressure is indicated by an output signal of a sensor provided downstream of a purge port in the intake passage, and a canister in a fuel supply system communicates with the purge port via a purge control valve or vacuum switching valve at an intermediate portion of a fuel vapor supply conduit. In the above mentioned fuel control apparatus, when the air fuel mixture is tending to be too lean, the amount of fuel vapor purged through the intake passage to correct the amount of fuel injected is controlled to increase.

However, in a case of an internal combustion engine in which the flow rate of intake air is measured by a signal from an air flow meter provided upstream of the purge port in the intake passage, it is difficult to perform accurate control of the air-fuel ratio. That is, if the amount of fuel vapor purged into the intake passage is controlled to increase when the air-fuel ratio of the mixture is detected to be too small, the air fuel mixture becomes excessively lean when the concentration of fuel vapor in the intake mixture is low. Therefore, there is a problem in that the fuel control apparatus of the internal combustion engine of the type described above cannot always achieve accurate control of the air-fuel ratio when the air fuel mixture is particularly lean.

SUMMARY OF THE INVENTION

Accordingly, it is a general object of the present invention to provide an improved evaporative fuel control apparatus in which the above described problems of the prior art apparatus are eliminated.

Another and more specific object of the present invention is to provide an evaporative fuel control apparatus in which both the fuel purging amount and the fuel injection amount are corrected in response to the concentration of fuel vapor so as to invariably and accurately converge the air fuel mixture toward the stoichiometric air-fuel ratio. The above mentioned object of the present invention can be achieved by an evaporative fuel control apparatus which comprises a detection part for detecting operating conditions of an internal combustion engine and for supplying signals indicative of the operating conditions, a purge part for controlling a flow of fuel vapor from a fuel tank into an intake passage of the internal combustion engine, a calculation part for calculating a fuel injection amount in response to the signals supplied by the detection part, a first injection control part for varying a feedback correction factor of an air-fuel ratio of air fuel mixture, in response to the signals supplied by the detection part, so as to maintain the air-fuel ratio at a stoichiometric value, and for correcting the fuel injection amount being calculated by the calculation part with the thus varied feedback correction factor, a second injection control part for correcting the fuel injection amount being calculated by the calculation part, in response to a fuel vapor concentration which is determined from the varied feedback correction factor by the first injection control part, and a purge correction part for correcting a purging amount of fuel vapor which is fed by the purge part into the intake passage, in response to the fuel vapor concentration determined from the varied feedback correction factor. According to the present invention, it is possible to suitably control the air-fuel ratio so that it is maintained convergently at the stoichiometric air-fuel ratio. With the purging of fuel vapor made by the purge part, the second injection control part corrects the amount of fuel injected in response to the concentration of fuel vapor, and the purge correction part corrects the amount of fuel vapor purged by the purge part in response to the concentration of fuel vapor. Therefore, when the concentration of fuel vapor is high and the correction made by the second injection control part is not enough, the amount of fuel vapor purged is corrected by the purge correction part for achieving accurate control of the air-fuel ratio relative to the stoichiometric air-fuel ratio.

Still another object of the present invention is to provide an evaporative fuel control apparatus of an internal combustion engine in which the amount of fuel vapor purged is suitably controlled in response to the amount of the correction to correct the amount of fuel injected due to the fuel vapor purging, so that accurate control of the air-fuel ratio at the stoichiometric air-fuel ratio is achieved. According to the present invention, it is possible to suitably correct the amount of fuel vapor purged in response to the amount of the correction to correct the amount of fuel injected. In a case where the air-fuel ratio of the engine fluctuates due to an excessive purge correction amount, it is possible to control suitably the amount of fuel vapor purged to eliminate such an excessive correction amount, thus accurately maintaining the air-fuel ratio at the stoichiometric value. Also, according to the present invention, the second injection control part corrects the amount of fuel injected in response to the amount of fuel vapor purged by the purge correction part. In a case where the air-fuel ratio of the engine fluctuates due to an excessive purge correction amount, it is possible to control suitably the amount of the correction due to the fuel vapor purging to correct the amount of fuel injected for eliminating such an excessive correction amount, thus invariably converging the air-fuel ratio at the stoichiometric value.

Other objects and further features of the present invention will become more apparent from the following detailed description when read in conjunction with the accompanying drawings.

DESCRIPTION OF THE PREFERRED EMBODIMENTS

Figure 1:
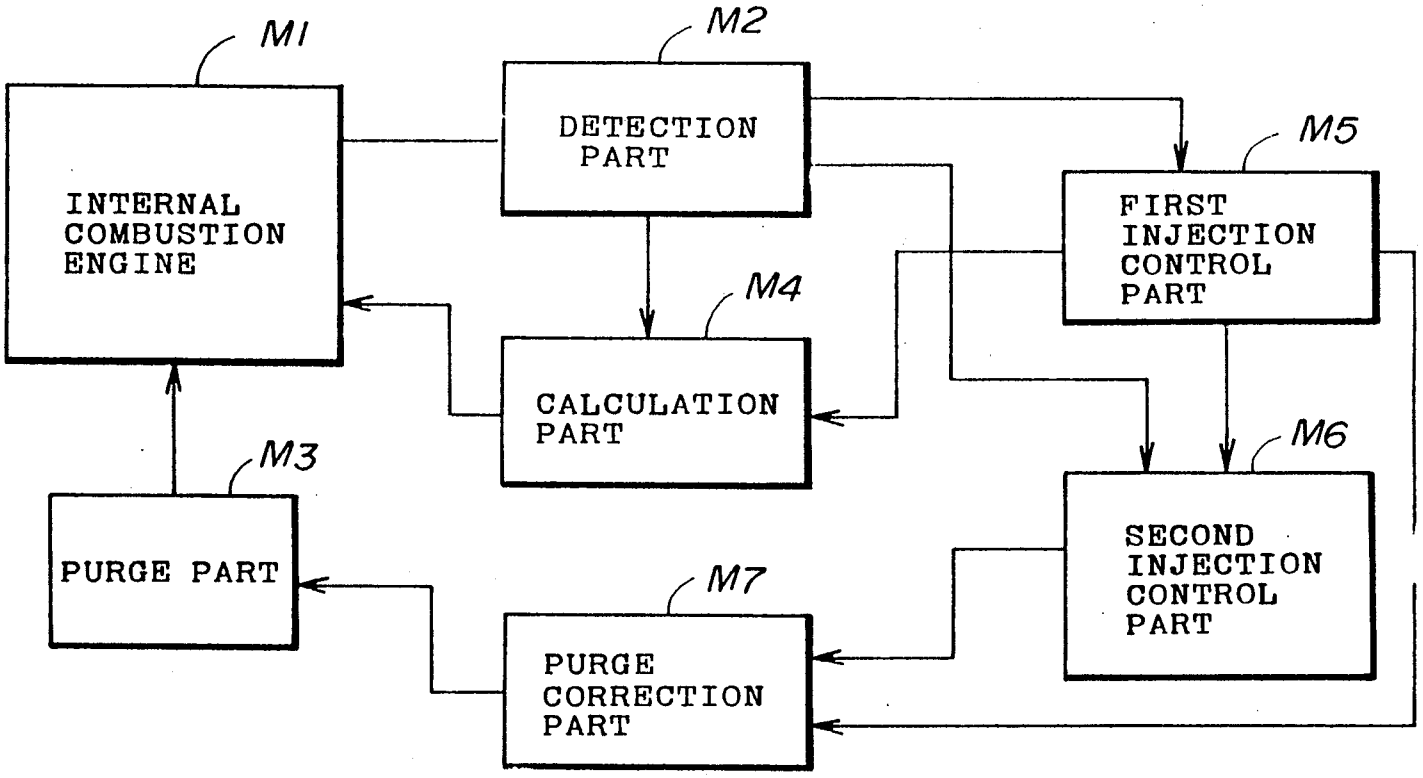
FIG. 1 is a block diagram for explaining a construction of a first embodiment of an evaporative fuel control apparatus according to the present invention.

First, a description will be given of essential parts of an evaporative fuel control apparatus according to the present invention, with reference to FIG. 1. FIG. 1 shows an embodiment of an evaporative fuel control apparatus according to the present invention. The evaporative fuel control apparatus shown in FIG. 1 generally has an internal combustion engine M1, a detection part M2, a purge part M3, a calculation part M4, a first injection control part M5, a second injection control part M6 and a purge correction part M7. The detection part M2 detects operating conditions of the internal combustion engine M1 and supplies detection signals. The purge part M3 purges fuel vapor from a fuel tank to an intake system. The calculation part M4 calculates the amount of fuel being injected into the internal combustion engine M1 in response to the detection signals from the detection part M2. The first injection control part M3 varies a feedback correction factor of the air-fuel ratio in response to the detection signals from the detection part M2 so as to converge the air-fuel ratio of intake mixture toward the stoichiometric air-fuel ratio, thereby correcting the amount of fuel injected which is calculated by the calculation part M2. The second injection control part M6 corrects the amount of fuel injected, which is calculated by the calculation part M2, in response to the concentration of fuel vapor in the intake mixture determined by the feedback correction factor from the first injection control part M5. And, the purge control part M7 corrects the amount of fuel vapor being purged by the purge part M3 in response to the fuel vapor concentration. With the fuel vapor purging by the purge part M3, the second injection control part M6 corrects the amount of fuel injected in response to the fuel vapor concentration, and the purge correction part M7 corrects the amount of fuel vapor purged by the purge part M3 in response to the fuel vapor concentration. When the fuel vapor concentration is high and the second injection control part M6 cannot correct suitably the amount of fuel injected, the amount of fuel purged is corrected by the purge correction part M7.

Figure 2:
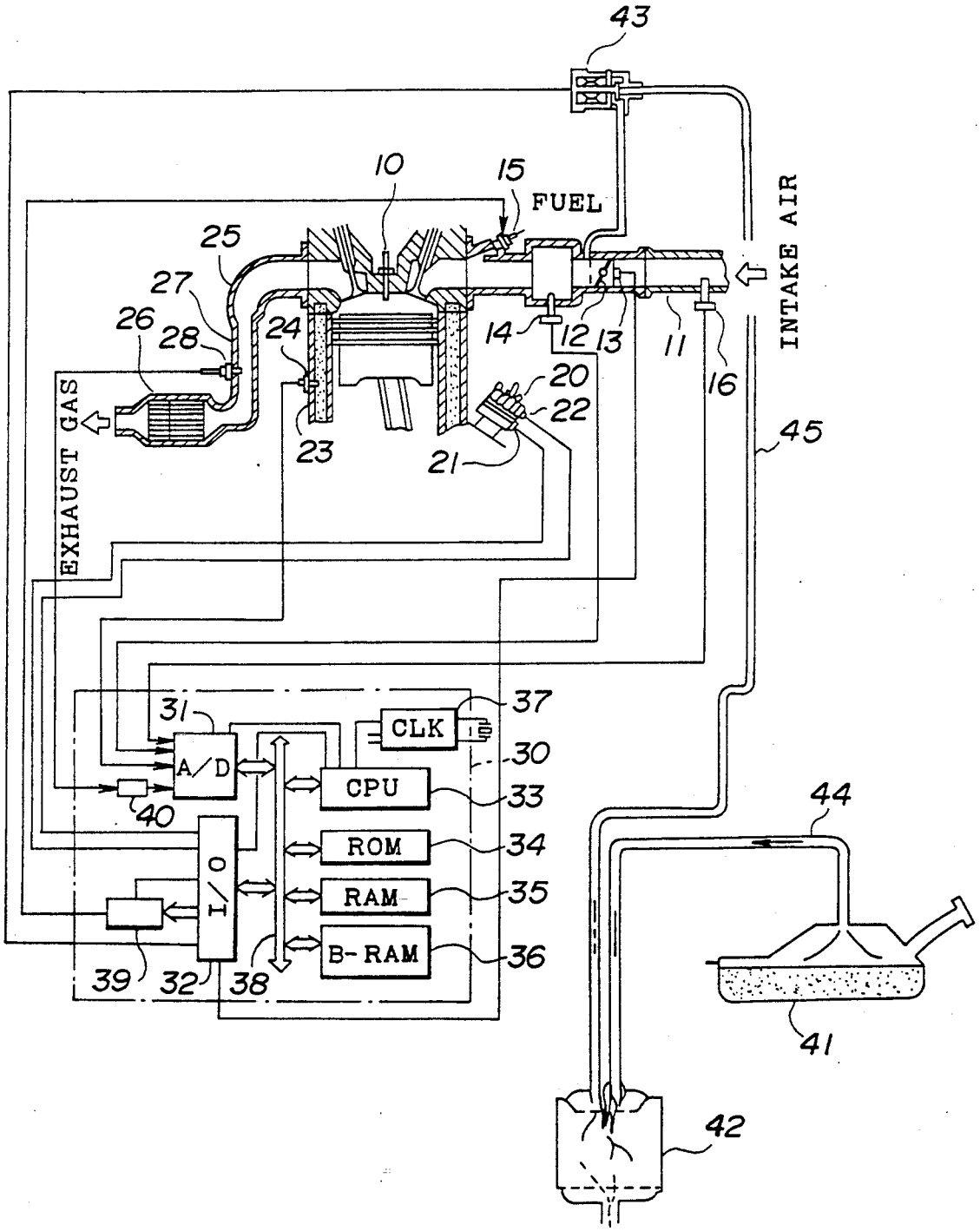
FIG. 2 is a schematic view showing an internal combustion engine to which an evaporative fuel control apparatus according to the present invention is applied.

Next, a description will be given of an internal combustion engine to which an embodiment of an evaporative fuel control apparatus according to the present invention is applied. In FIG. 2, this internal combustion engine 10 has an intake passage 11 in which a throttle valve 12 is provided, and on a portion of a shaft of the throttle valve 12 a throttle position sensor 13 is mounted for sensing a valve opening position of the throttle valve 12 which is rotated around the shaft thereof. Downstream of the throttle position sensor 13 in the intake passage 11, a pressure sensor 14 is provided for measuring a pressure of intake air entering the intake passage 11. Downstream of the pressure sensor 14 in the intake passage 11, a fuel injection valve (or, fuel injector) 15 is provided for each of cylinders of the internal combustion engine 10, to supply fuel under pressure from a fuel supply system to an intake port of the engine 10. The intake passage 11 includes an intake air temperature sensor 16 provided therein for supplying an analog signal of a voltage in response to the temperature of intake air to an A/D (analog-to-digital) converter 31 in an electronic control unit 30. The pressure sensor 14 supplies an analog signal of a voltage to the A/D converter 31 in response to the flow rate of intake air.

The internal combustion engine 10 includes a distributer 20, and in this distributer 20, there are provided two crank angle sensors 21, 22, the crank angle sensor 21 supplying a reference pulse signal to an I/O interface 32 of the electronic control unit 30 each time a shaft of the distributer 20 is rotated by 720 CA degrees (CA refers to engine crank angle), the crank angle sensor 22 supplying a reference pulse signal to the I/O interface 32 each time the distributer shaft is rotated by 30 CA degrees. These reference pulse signals from the sensors 21, 22 are used as a request signal for interruption of a fuel injection timing, a request signal for interruption of a timing signal for spark timing or a request signal for interruption of fuel injection control.

In a cooling water passage 23 of the internal combustion engine 10, a water temperature sensor 24 is provided for sensing the temperature THW of cooling water, and the water temperature sensor 24 supplies an analog signal of a voltage in response to the cooling water temperature THW to the A/D converter 31.

In an exhaust system which is provided downstream of an exhaust manifold 25, a three-way catalytic converter 26 is mounted for oxidizing and reducing three major pollutants HC, CO, NOx in exhaust gas from the exhaust manifold 25 to decrease the ratio of harmful components of the exhaust gas. In an exhaust pipe 27 between the exhaust manifold 25 and the catalytic converter 26, an oxygen sensor 28 is mounted to detect a concentration of oxygen in the exhaust gas flowing out from the combustion chamber of the internal combustion engine to the exhaust pipe 27. The oxygen sensor 28 generates an output signal of a voltage in accordance with the oxygen concentration of the exhaust gas, and supplies the same to the A/D converter 31 of the electronic control unit 30 via a signal processing circuit 40. The voltage of this output signal supplied by the oxygen sensor 28 is varied to one of two different voltages, depending on whether the air fuel mixture is lean or rich in comparison with the stoichiometric air-fuel ratio. In addition, an ON/OFF signal of a key switch (not shown) is supplied to the I/0 interface 32 when the key switch is turned On and OFF, and an output signal of an engine speed sensor (not shown) is supplied to the A/D converter 31, this output signal being produced as an analog signal of a voltage proportional to an engine speed of the internal combustion engine 10.

With the internal combustion engine 10 thus constructed, an evaporative emission control system is provided to prevent fuel vapor from a fuel tank 41 from escaping to the atmosphere. This evaporative emission control system has a charcoal canister 42 and an electric vacuum switching valve (hereinafter called a VSV) 43 which is provided as the purge part M3 of the evaporative fuel control apparatus of the present invention. The charcoal canister 42 is connected to the fuel tank 41 by a vapor collecting conduit 44, and this vapor collecting conduit 44 projects from a top of the fuel tank 41, so that fuel vapor evaporated from the fuel tank 41 is adsorbed by activated carbon of the charcoal canister 42. A vapor supply conduit 45 is provided so as to connect the charcoal canister 42 to the intake passage 11, so that the fuel vapor adsorbed by the charcoal canister 42 is returned to a portion of the intake passage 11 downstream of the throttle valve 12. The VSV 43 is a kind of an electromagnetic control valve which is opened and closed in response to a signal supplied by the electronic control unit 30, and the VSV 43 is mounted at an intermediate portion of the vapor supply conduit 45 between the charcoal canister 42 and the intake passage 11 so that the flow of fuel vapor from the charcoal canister 42 to the intake passage 11 through the vapor supply conduit 45.

When the key switch (not shown) is turned ON, the electronic control unit 30 starts the execution of a control program stored therein so that several output signals are received from the above described sensors and the operation of the fuel injection valve 15 and the other actuators is controlled by the electronic control unit 30.

The electronic control unit 30 is formed with a microcomputer, for example, and this electronic control unit 30 includes the A/D converter 31, the I/O interface 32, the CPU 33, a ROM (read only memory) 34, a RAM (random access memory) 35, a backup RAM 36 retaining information stored therein after the key switch is turned OFF, a CLK (clock) 37, and a bidirectional bus 38 interconnecting the above elements of the electronic control unit 30 as shown.

The fuel injection control circuit 39 in the electronic control unit 30 includes a down counter, a flipflop and a drive circuit, and this fuel injection control circuit 39 controls the operation of the fuel injection valve 15. A basic injection amount Tp is calculated from the intake air pressure and the engine speed, and this basic injection amount Tp is corrected in response to the operating conditions of the internal combustion engine 10 supplied from the relevant sensors to calculate a fuel injection amount amount TAU. This fuel injection amount TAU is supplied to the down counter of the injection control circuit 39. Then, the fuel injection amount TAU is preset to the down counter of the circuit 39, and the flipflop thereof is switched so that the drive circuit of the injection control circuit 39 starts operation of the fuel injection valve 15. On the other hand, the down counter performs a counting of clock signals (not shown) until an output terminal of the down counter is finally set to a high level, or "1" level. When the output terminal of the down counter is turned to the high level, the flipflop is reset so that the drive circuit stops activation of the fuel injection valve 15. In other words, the fuel injection valve 15 is opened to feed the amount of fuel to a combustion chamber of the internal combustion engine 10, and the amount of fuel injected to the combustion chamber is proportional to the above mentioned fuel injection amount TAU thus calculated.

Next, a description will be given of a control program to control operation of the vacuum switching valve (VSV) 43, which is processed by the purge correction part M7 of the present invention. The electronic control unit 30 supplies a pulse signal to the VSV 43, the pulse signal having a duty factor DPG which is varied at a given frequency. When the pulse signal supplied by the electronic control unit 30 to the VSV 43 is at a high level, the VSV 43 is opened to purge fuel vapor into the intake system. The amount of fuel vapor purged is varied in proportion to the duty factor DPG of the pulse signal supplied by the electronic control unit 30 to the VSV 43. Therefore, it is possible to control suitably the amount of fuel vapor purged into the intake system, by changing the duty factor DPG of the pulse signal supplied to the VSV 43.

Figure 3:
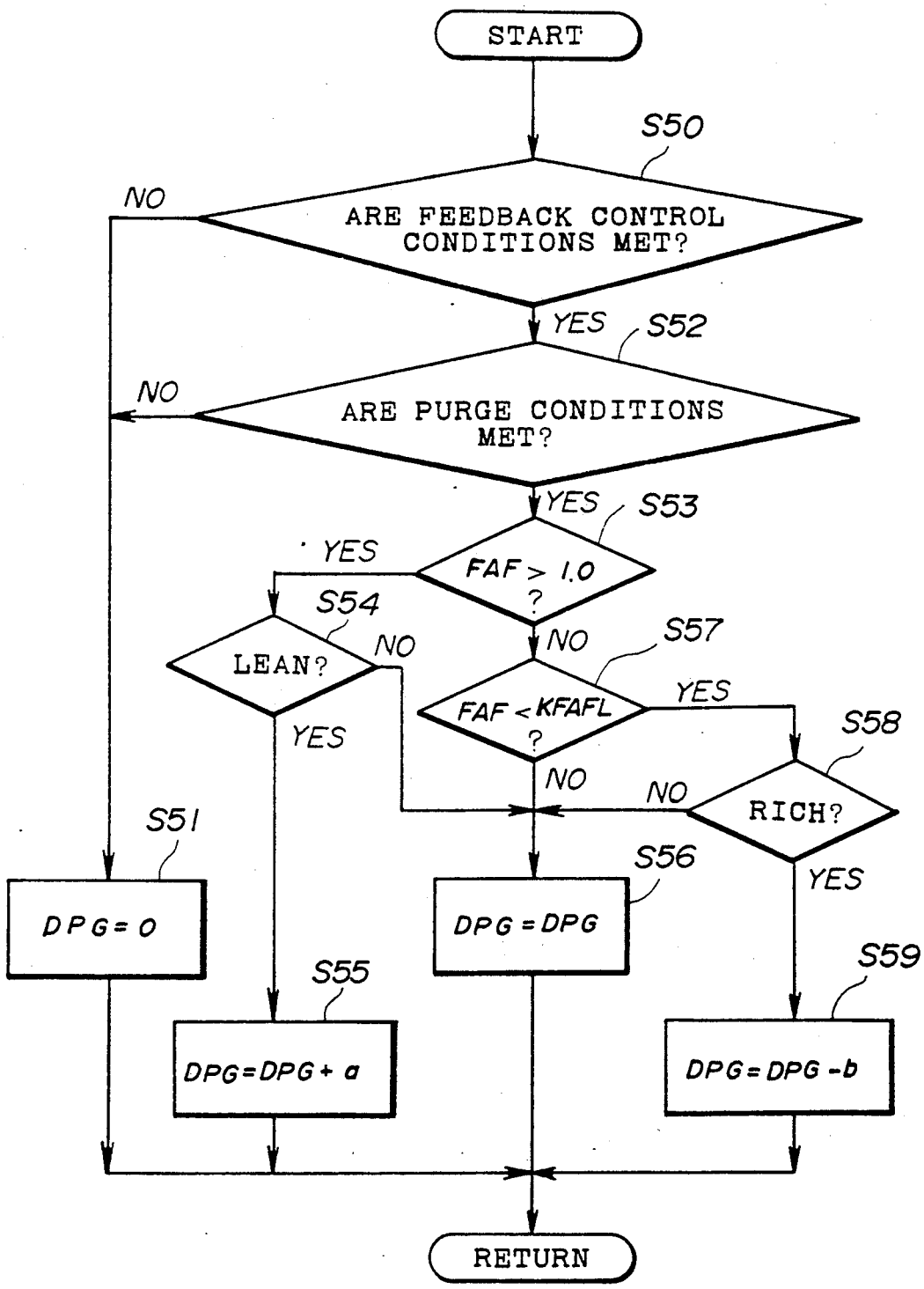
FIG. 3 is a flow chart for explaining a purge controlling routine of the first embodiment of the present invention.

FIG. 3 shows a VSV valve control routine to control the operation of the VSV 43 for adjusting the amount of fuel vapor purged, which is processed by the purge correction part M7. This routine is executed only when the average value FAFav of a feedback correction factor FAF meets the requirement: $0.95 < FAFav < 1.05$. The execution of the VSV controlling routine may be made by an interrupt at time intervals of one second, for example. In this case, once the average value FAFav has met the above requirement, the VSV valve control routine is continuously performed, that is, the execution of this routine is not hindered even if the average of the FAF does not meet the above requirement later.

In the purge valve controlling routine as shown in FIG. 3, in a step S50, a determination is made on whether feedback control conditions are met by the internal combustion engine. The feedback control conditions include: (1) cooling water temperature is higher than a given level; (2) the engine is not in idling condition; (3) the engine is not running in heavy load condition; and (4) the engine is not in fuel cut condition. If any of the feedback control conditions is not met, then the duty factor DPG is set to zero in a step S51 so that the purging of fuel vapor is stopped. If all the above mentioned feedback control conditions are met, then a determination is made on whether purge conditions are met by the internal combustion engine in a step S52. The purge conditions include: (1) more than 30 seconds elapse after the engine starts idling; (2) more than 5 seconds elapse after the idling switch is turned ON; (3) vehicle speed is higher than 2 km/h; and (4) intake air temperature is higher than 45 deg C. If any of the above purge conditions is not met, then the duty factor DPG is set to zero in the step S51.

When the feedback control conditions are met and the purge conditions are met, a determination is made on whether the value of the feedback correction factor FAF is greater than 1.0 in a step S53. If the value of the FAF is greater than 1.0, then, in a step S54, a determination is made on whether the air fuel mixture is lean on the basis of an output signal of the oxygen sensor 28. When the air fuel mixture is detected to be lean, the value of the duty factor DPG is incremented by a given quantity "a" in a step S55. This given quantity "a" is equivalent to, for example, 10% of the value of the DPG. When the air fuel mixture is detected to be rich from the output signal of the oxygen sensor 28, the duty factor DPG remains unchanged in a step S56.

According to the present invention, the duty factor DPG is incremented by a given quantity "a", to increase the amount of fuel vapor purged, only when the feedback correction factor FAF is greater than 1.0 and the output signal of the oxygen sensor 28 indicates that the air fuel mixture is lean and the FAF still changes to a value outside a lean-side range between 1.0 and the KFAFH in which the fuel injection amount should be adjusted to increase. On the other hand, when the feedback correction factor FAF is greater than 1.0 but the output signal of the oxygen sensor 28 indicates that the air fuel mixture is rich and that the FAF changes to a value within the lean-side range, the prohibition part M6 of the present invention serves to prevent the duty factor DPG from being incremented further, so that the duty factor DPG is not adjusted to increase the amount of fuel vapor purged.

When the feedback correction factor FAF is not greater than 1.0 in the step S53, the value of the FAF is compared with a predetermined reference level KFAFL in a step S57. This reference level KFAFL may be equal to 0.95, for example. If the value of the FAF is greater than the predetermined reference level KFAFL and smaller than 1.0, then the value of the duty factor DPG remains unchanged in the step S56. If the value of the FAF is smaller than the KFAFL, then a determination is made on whether the output signal of the oxygen sensor 28 describes the air fuel mixture as rich in a step S58. If the air fuel mixture is detected to be lean in the step S58, then the value of the duty factor DPG remains unchanged in the step S56. If the mixture is detected to be rich in the step S58, then the value of the duty factor DPG is decremented by a given quantity "b" in a step S59. This given quantity "b" is equivalent to, for example, 5% of the value of the duty factor DPG.

According to the present invention, the duty factor DPG is decremented by a given quantity "b" to decrease the amount of fuel vapor purged, only when the feedback correction factor FAF is smaller than the predetermined low reference level KFAFL and the output signal of the oxygen sensor 28 indicates that the air fuel mixture is rich and that the FAF still changes to a value outside a rich-side range in which the fuel injection amount should be adjusted to decrease. On the other hand, when the feedback correction factor FAF is smaller than the predetermined low reference level KFAFL but the output signal of the oxygen sensor 28 indicates that the air fuel mixture is lean and that the FAF changes to a value within the rich-side range between the KFAFL and 1.0, the prohibition part M6 serves to prevent the duty factor DPG from being decremented further, so that the duty factor DPG is not adjusted to decrease the amount of fuel vapor purged excessively.

Figure 4:
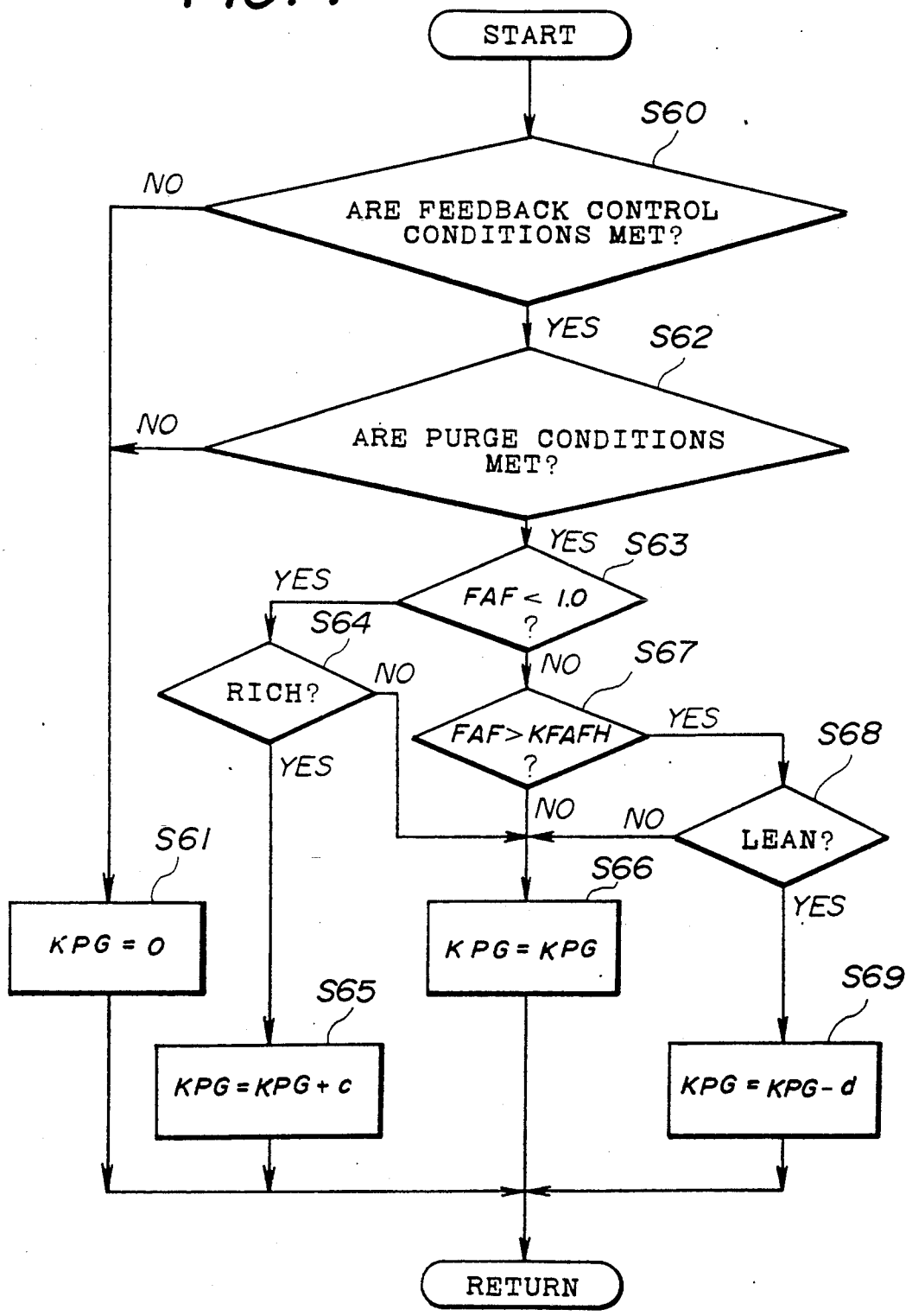
FIG. 4 is a flow chart for explaining a calculation routine to calculate the purge correction amount in the first embodiment.

FIG. 4 shows a calculation routine to calculate the purge correction amount, which is performed by the second injection control part M6 of the present invention. The purge correction amount hereinafter means the amount of correction to correct the fuel injection amount by the purging of fuel vapor controlled by the VSV 43 into the intake passage 11. This calculation routine may be executed by an interrupt at time intervals of 65 msec, for example. In the calculation routine shown in FIG. 4, in a step S60, a determination is made on whether the feedback control conditions are met by the internal combustion engine 11. The feedback control conditions in this case are the same as described above. If any of the feedback control conditions is not met, then a purge correction amount KPG is set to zero in a step S61. This purge correction amount KPG is the amount of the correction due to the fuel vapor purging to correct the amount of fuel injected. The purge correction amount KPG being set to zero in the step S61 is equivalent to the amount of correction when the engine runs at reference idling speed which is, for example, 600 revolutions per minute (600 rpm).

If all the above feedback control conditions are met in the step S60, then a determination is made on whether the purge conditions are met by the internal combustion engine in a step S62. The purge conditions are the same as described above. If any of the above purge conditions is not met, the purge correction amount KPG is set to zero in the step S61.

When both the feedback control conditions and the purge conditions are met, a determination is made on whether the value of the feedback correction factor FAF is smaller than 1.0 in a step S63. If the value of the FAF is smaller than 1.0, then a determination is made on whether the air fuel mixture is rich on the basis of an output signal of the oxygen sensor 28 in a step S64. When the air fuel mixture is detected to be rich, the value of the purge correction amount KPG is incremented by a given quantity "c" in a step S65. This given quantity "c" may be equal to 5 μsec, for example. When the air fuel mixture is detected not to be rich in the step S64, the purge correction amount KPG remains unchanged in a step S66.

According to the present invention, the purge correction amount KPG is incremented by a given quantity "c" to decrease the fuel injection amount, only when the feedback correction factor FAF is smaller than 1.0 and the output signal of the oxygen sensor 28 indicates that the air fuel mixture is rich and the FAF still changes to a value outside a rich-side range between the KFAFL and 1.0 in which the fuel injection amount should be decreased. On the other hand, when the FAF is smaller than 1.0 but the output signal of the oxygen sensor 28 indicates that the air fuel mixture is lean and that the FAF changes to a value within the rich-side range, the prohibition part M6 of the present invention serves to prevent the purge correction amount KPG from being incremented further, so that the purge correction amount KPG is not adjusted to decrease the fuel injection amount excessively.

When the feedback correction factor FAF is not smaller than 1.0 in the step S63, the value of the FAF is compared with a predetermined reference level KFAFH in a step S67. The value of this reference level KFAFH may be equal to 1.05, for example. If the value of the FAF is smaller than the predetermined reference level KFAFH and greater than 1.0, then the value of the purge correction amount KPG remains unchanged in the step S66. If the value of the FAF is greater than the KFAFH, then a determination is made on whether the output signal of the oxygen sensor 28 indicates that the air fuel mixture is lean, in a step S68. If the air fuel mixture is detected not to be lean in the step S68, then the purge correction amount KPG remains unchanged in the step S66. If the air fuel mixture is detected to be lean, then the purge correction amount KPG is decremented by a given quantity "d" in a step S69. This given quantity "d" may be equal to 5 μsec, for example.

According to the present invention, the purge correction amount KPG is decremented by a given quantity "d" to increase the fuel injection amount, only when the feedback correction factor FAF is greater than the high reference level KFAFH and the output signal of the oxygen sensor 28 indicates that the air fuel mixture is lean and that the FAF changes to a value outside the lean-side range between 1.0 and the KFAFH in which the fuel injection amount should be increased. On the other hand, when the FAF is greater than the KFAFH and the output signal of the oxygen sensor 28 indicates that the air fuel mixture is rich and that the FAF changes to a value within the lean-side range, the prohibition part M6 serves to prevent the purge correction amount KPG from being decremented further, so that the fuel injection amount is not adjusted to increase the fuel injection amount excessively.

Figures 5, 6:
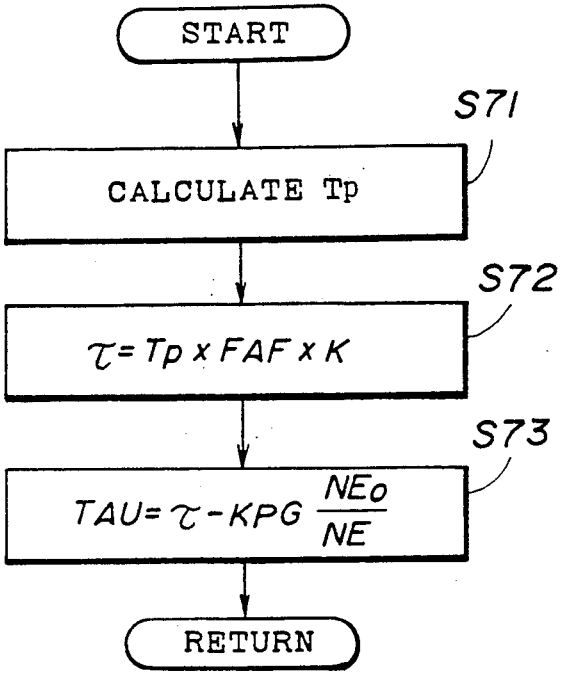
FIG. 5 is a flow chart for explaining a calculation routine to calculate the fuel injection amount in the first embodiment.
FIG. 6 is a table for explaining a relationship between a duty factor and a purge correction amount with respect to the feedback correction factor.

FIG. 5 shows a calculation routine to calculate the fuel injection amount, which is performed by the calculation part M4. In this calculation routine shown in FIG. 5, a basic fuel injection amount Tp is calculated on the basis of an intake air pressure PM and an engine speed NE in a step S71. The intake air pressure PM and the engine speed NE are detected and the detection signals are supplied by the related sensors to the electronic control unit 30. In a step S72, a fuel injection amount $\tau$, before the feedback correction is made, is determined from the basic fuel injection amount Tp in the step S71, the feedback correction factor FAF and a given coefficient K by the following formula:

$$\tau = Tp \times FAF \times K \quad (1)$$

The determination of the fuel injection amount $\tau$ in the step S72 is performed by the first injection control part M5 of the present invention. In a step S73, the actual fuel injection amount TAU after the feedback correction is determined from the fuel injection amount $\tau$ in the step S72, the purge correction amount KPG, a reference idling speed NE0 and the engine speed NE, by the following formula:

$$TAU = \tau - (KPG \times NE0/NE) \quad (2)$$

The purge valve controlling routine shown in FIG. 3 and the purge correction amount oalculation routine shown in FIG. 4 are thus carried out according to the present invention. FIG. 6 shows a relationship between the duty factor DPG and the purge correction amount KPG with respect to the feedback correction factor FAF. As shown in FIG. 6, the duty factor DPG and the purge correction amount KPG are varied depending on the value of the feedback correction factor FAF as described above. When the value of the feedback correction factor FAF is greater than the given reference level KFAFH, the duty factor DPG is increased and the purge correction amount KPG is decreased. When the value of the FAF is smaller than the given reference level KFAFH and greater than 1.0, the duty factor DPG is increased and the purge correction amount KPG remains unchanged. When the value of the FAF is smaller than 1.0 and greater than the given reference level KFAFL, the duty factor DPG remains unchanged and the purge correction amount KPG is increased. And, when the value of the feedback correction factor FAF is smaller than the reference level KFAFL, the duty factor DPG is decreased and the purge correction amount KPG is increased.

Figure 7A:
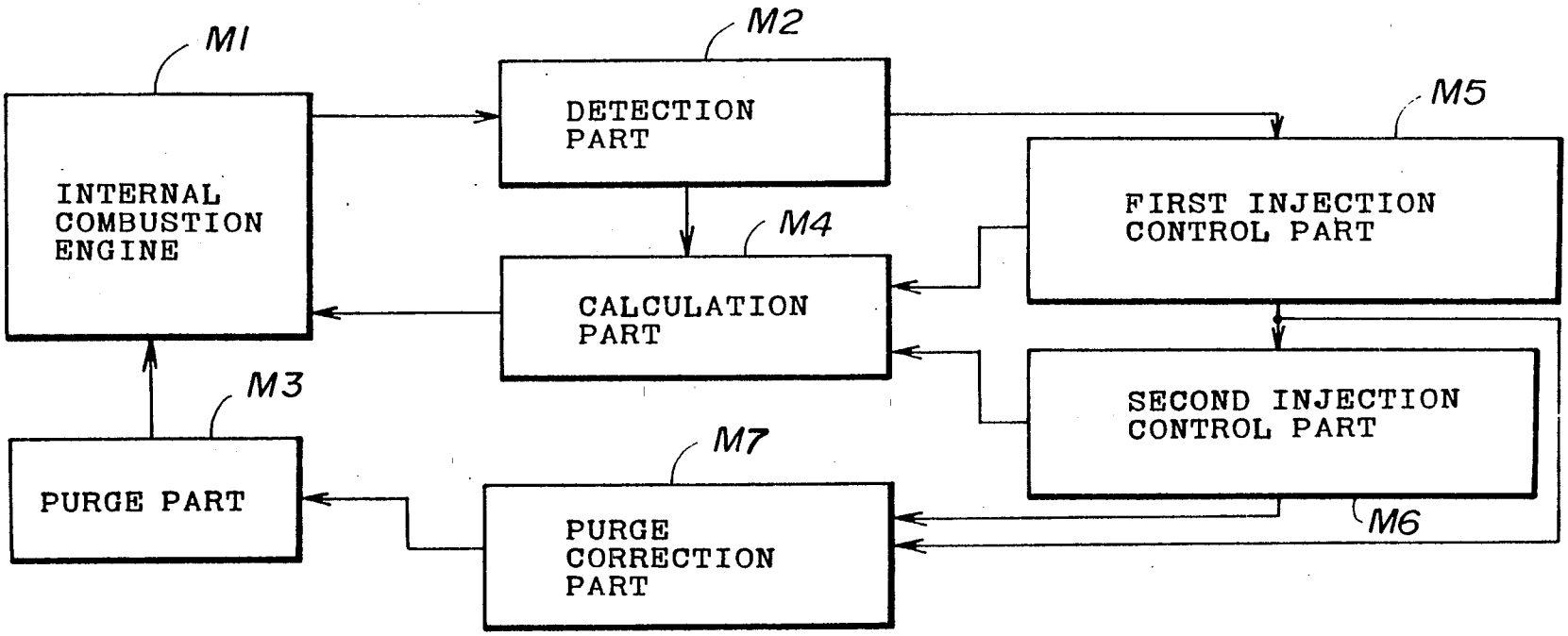
FIGS. 7A and 7B are block diagrams for explaining a construction of a second embodiment of an evaporative fuel control apparatus according to the present invention.
Figure 7B:
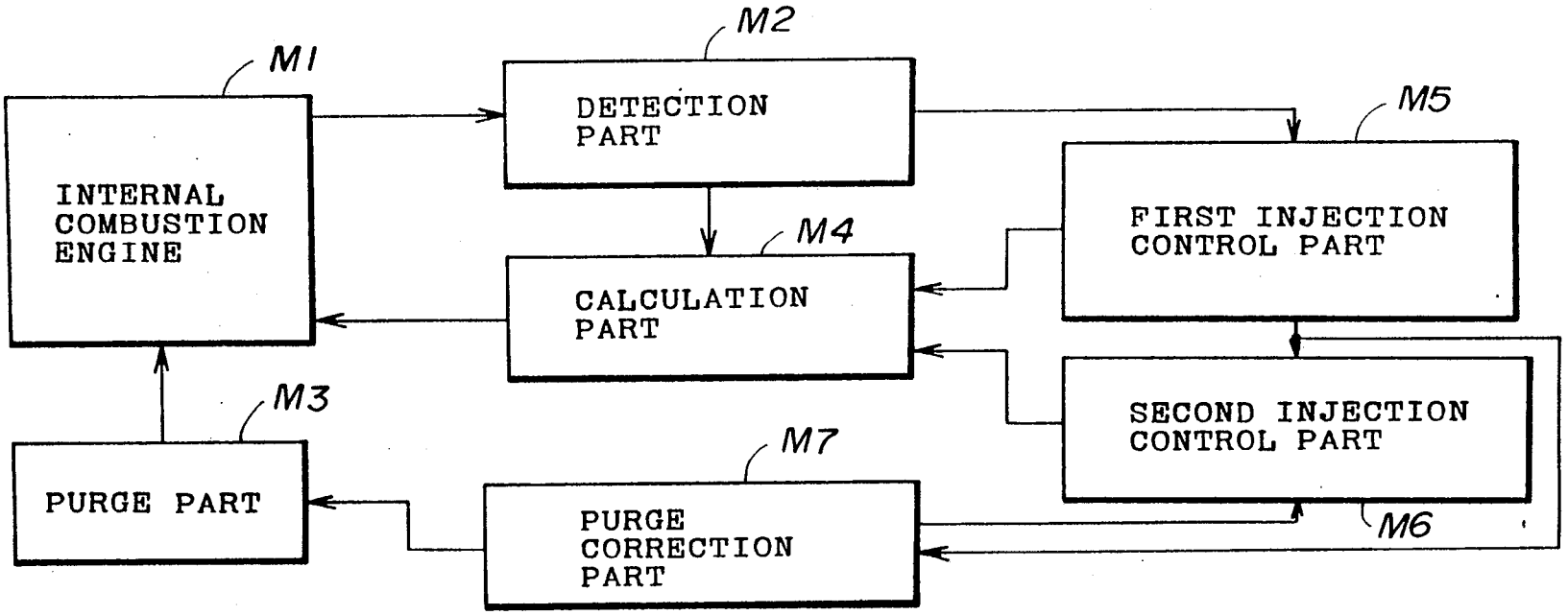

Another aspect of the present invention is directed to an evaporative fuel control apparatus as shown in FIGS. 7A and 7B, which is essentially the same as the apparatus shown in FIG. 1. Those parts of this evaporative fuel control apparatus shown in FIGS. 7A and 7B which are essentially the same as those corresponding parts in FIG. 1 are designated by the same reference numerals, and a description thereof will be omitted. However, in the evaporative fuel control apparatus shown in FIG. 7A, the second injection control part M6 corrects the amount of fuel injected, which is calculated by the calculation part M4, in response to a fuel vapor concentration in the intake mixture determined from the feedback correction factor of the air-fuel ratio. And, the purge correction part M7 corrects the amount of fuel vapor purged by the purge part M3, in response to the fuel vapor concentration thus determined and in response to the amount of correction by the second injection control part M6 to correct the amount of fuel injected. And, in the evaporative fuel control apparatus shown in FIG. 7B, which is also essentially the same as the apparatus shown in FIG. 1, the second injection control part M6 corrects the amount of fuel injected, which is calculated by the calculation part M4, in response to the fuel vapor concentration in the intake mixture determined from the feedback correction factor and in response to the amount of correction by the purge correction part M7.

Figure 8:
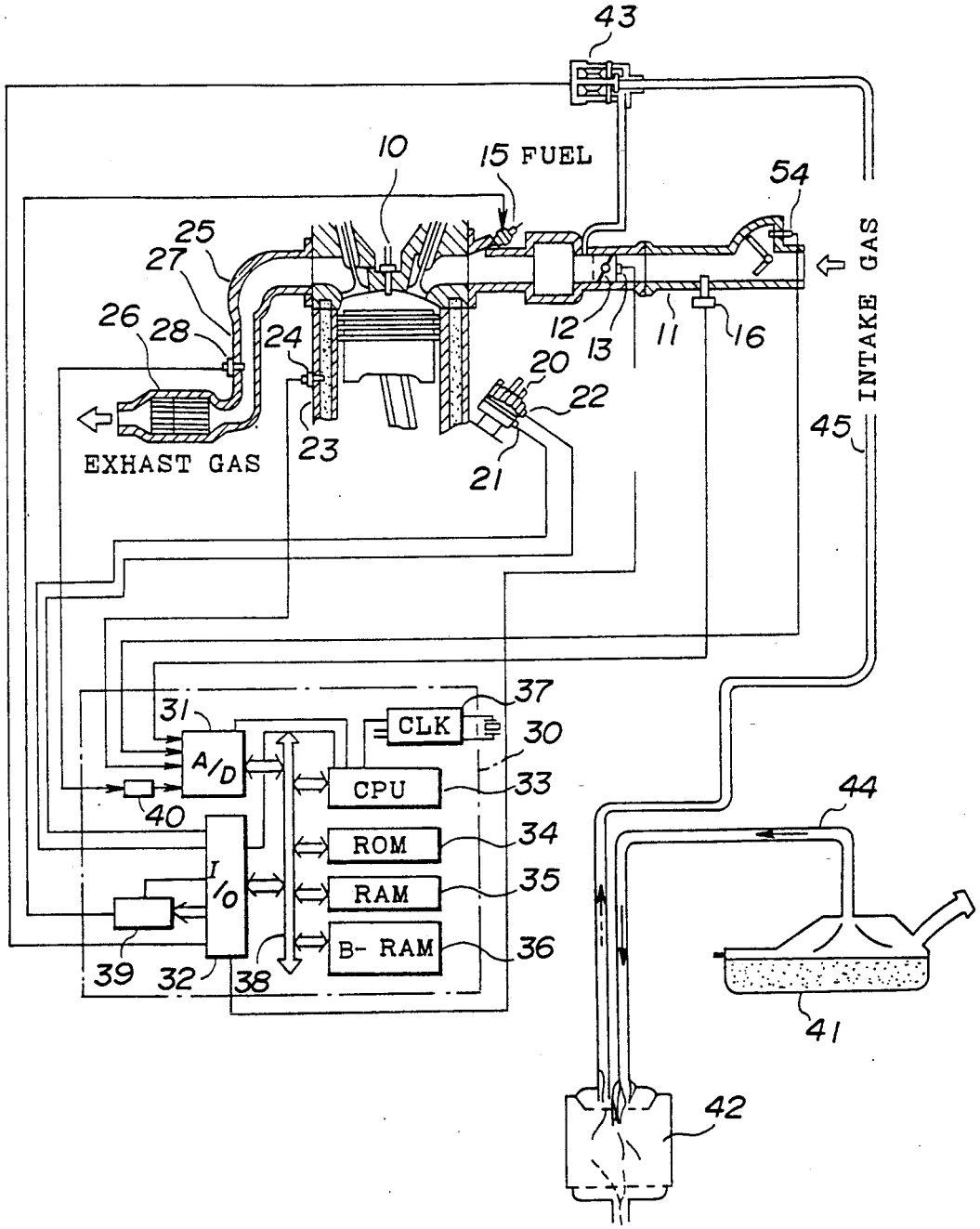
FIG. 8 is a schematic view showing an internal combustion engine to which the evaporative fuel control apparatus shown in FIGS. 7A and 7B is applied.

An internal combustion engine shown in FIG. 8 is essentially the same as the apparatus shown in FIG. 2. In FIG. 8, those parts which are essentially the same as those corresponding parts of the internal combustion engine shown in FIG. 2 are designated by the same reference numerals, and a description thereof will be omitted. However, in a case of the internal combustion engine shown in FIG. 8, an air flow meter 54 is mounted upstream of the throttle position sensor 13 in the intake passage 11, to measure a flow rate of intake air entering the intake passage 11 of the internal combustion engine thus constructed. The evaporative fuel control apparatus of the present invention shown in FIGS. 7A and 7B is applicable to this internal combustion engine shown in FIG. 8.

Figure 9:
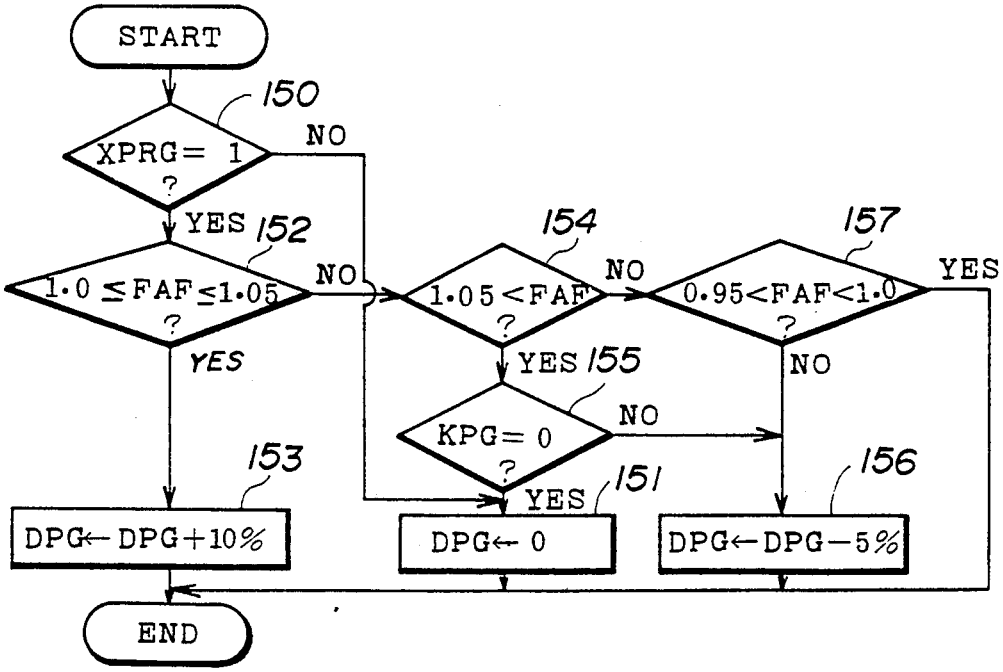
FIG. 9 is a flow chart for explaining a purge controlling routine of the second embodiment of the present invention.

FIG. 9 shows a purge valve controlling routine of the present invention, which is processed by the purge correction part M7 as shown in FIGS. 7A and 7B. In the purge valve controlling routine as shown in FIG. 9, in a step 150, a determination is made on whether a purge execution flag XPRG is set to a high level or "1" during the purging of fuel vapor to the intake system. In this step 150, the purging execution flag XPRG is set to a low level or "0" when neither the above mentioned feedback control conditions nor the above mentioned purge conditions are met. If the flag XPRG is set to "0" and the feedback control conditions and the purge conditions are not met, then the duty factor DPG is set to zero and the purging of fuel vapor is stopped in a step 151.

If the purge execution flag XPRG is set to "1", then a determination is made on whether the value of the feedback correction factor FAF of the air-fuel ratio is between 1.0 and 1.05, in a step 152. If the feedback correction factor FAF falls in this range, then the value of the duty factor DPG is incremented by 10% of the duty factor DPG in a step 153. If the feedback correction factor FAF does not fall in the range between 1.0 and 1.05 in the step 152, then a determination is made on whether the value of the feedback correction factor FAF is greater than 1.05, in a step 154. If the value of the feedback correction factor FAF is greater than 1.05, then a determination is made on whether the value of the purge correction amount KPG is equal to zero, in a step 155.

If the value of KPG is equal to zero in the step 155, the actual fuel injection amount is not decreased by the purge correction amount KPG, and the air-fuel mixture is lean because fuel vapor with a low concentration is being purged to the intake system. Thus, the duty factor DPG is set to zero and the purging of fuel vapor is stopped. If the value of the KPG is not equal to zero, it should be noted that the air fuel mixture is lean because of the fuel vapor purging amount and the purge correction amount. A step 156 is then performed so that the duty factor DPG is decreased by 5 percent.

If the value of the FAF is not greater than 1.05 in the step 154, then a determination is made on whether the value of the FAF is between 0.95 and 1.0 in a step 157. If the value of the FAF falls in the range between 0.95 and 1.0, then the duty factor DPG remains unchanged and the purge valve controlling routine is ended. If the value of the feedback correction factor FAF does not fall in the range between 0.95 and 1.0, or the value of the FAF is smaller than 0.95 indicating that the air fuel mixture is rich, then the duty factor DPG is decreased by 5 percent in the step 156.

Figure 10:
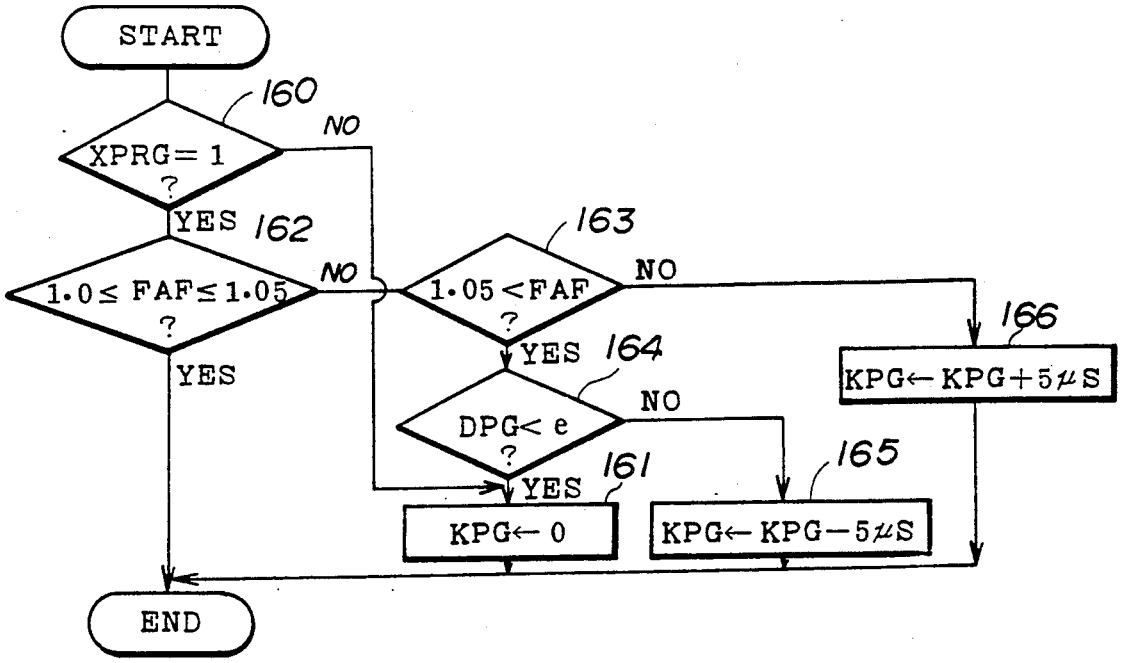
FIG. 10 is a flow chart for explaining a calculation routine to calculate the purge correction amount in the second embodiment.

FIG. 10 shows a calculation routine to calculate a purge correction amount KPG, which is processed by the second injection control part M6 of the present invention. This calculation routine is executed by an interrupt at time intervals of 65 msec, for example. In this calculation routine as shown in FIG. 10, a determination is made on whether the purge execution flag XPRG is set to "1" in a step 160, indicating that the purging of fuel vapor into the intake system is being made. If the purge execution flag XPRG is set to "0", then, in a step 161, the purge correction amount KPG is set to zero, so the purge correction to correct the amount of fuel injected is not made by the second injection control part M6. If the purge execution flag XPRG is set to "1", then a determination is made on whether the value of the feedback correction factor FAF falls in the range between 1.0 and 1.05, in a step 162. When the value of the FAF is in the range between 1.0 and 1.05, the purge correction amount KPG remains unchanged and this calculation routine is ended.

If the value of FAF does not fall in the range between 1.0 and 1.05 in the step 162, then a determination is made on whether the value of the FAF is greater than 1.05, in a step 163. If the value of the FAF is greater than 1.05 in the step 163, then a determination is made on whether the value of the duty factor DPG is smaller than a predetermined value "e", which is slightly greater than zero, in a step 164. If the value of the duty factor DPG is smaller than the predetermined value "e", the amount of fuel vapor purged is excessively small and the air fuel mixture is lean because the purge correction amount KPG is excessively large. Thus, in the step 161, the purge correction amount KPG is set to zero. When the value of the duty factor DPG is greater than the value "e", the air fuel mixture is lean due to the amount of fuel vapor purged as well as the purge correction amount KPG. Thus, in a step 165, the purge correction amount KPG is decreased by 5 μsec, to increase the amount of fuel vapor purged.

On the other hand, if the value of FAF is not greater than 1.05 in the step 163, then it is found that the value of FAF is smaller than 1.0, indicating that the air fuel mixture is too rich. Thus, the purge correction amount KPG is decreased by 5 μsec in the step 166.

Figures 11, 12:
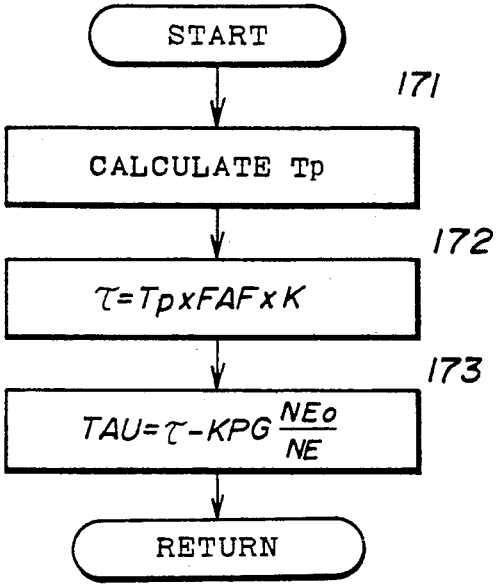
FIG. 11 is a flow chart for explaining a calculation routine to calculate the fuel injection amount in the second embodiment.
FIG. 12 is a table for explaining a relationship between the duty factor and the purge correction amount with respect to the feedback correction factor.

FIG. 11 shows a calculation routine to calculate the fuel injection amount TAU, which is processed by the calculation part M4 of the present invention. In this calculation routine shown in FIG. 11, a basic fuel injection amount Tp is calculated on the basis of an intake air flow rate Q and an engine speed NE, in a step 171. The intake air flow rate Q and the engine speed NE are sensed and supplied by the related sensors mounted on the internal combustion engine. In a step 172, a fuel injection amount $\tau$, before the feedback correction is made, is determined from the basic fuel injection amount Tp in the step 171, the feedback correction factor FAF and a given coefficient K. This calculation of the fuel injection amount $\tau$ is represented by the formula (1) above. The determination of the fuel injection amount $\tau$ in the step 172 is made by the first injection control part M5 of the present invention. In a step 173, the actual fuel injection amount TAU after the feedback correction is made is determined from the initial fuel injection amount $\tau$ in the step 172, the purge correction amount KPG, a reference idling speed NE0 and the engine speed NE, and this calculation of the actual fuel injection amount TAU is represented by the formula (2) above.

In the case of the evaporative fuel control apparatus shown in FIGS. 7A and 7B, the purge valve controlling routine as shown in FIG. 9 and the purge correction amount calculating routine as shown in FIG. 10 are thus processed. The duty factor DPG and the purge correction amount KPG are varied depending on the value of the feedback correction factor FAF, as shown in FIG. 12. In a first range in which the value of the feedback correction factor FAF is greater than 1.05, the duty factor DPG is set to zero when the purge correction amount KPG is equal to zero, and the DPG is decreased by the predetermined amount when the KPG is not equal to zero. In this first range of the FAF, the purge correction amount KPG is set to zero when the duty factor DPG is smaller than a given value "e", and the KPG is decreased when the DPG is greater than the given value "e". In a second range in which the value of the FAF is in the range between 1.0 and 1.05, the duty factor DPG is increased and the purge correction amount KPG remains unchanged. In a third range in which the value of the FAF is in the range between 0.95 and 1.0, the duty factor DPG remains unchanged and the purge correction amount KPG is increased. And, in a fourth range in which the value of the FAF is smaller than 0.95, the duty factor DPG is decreased and the purge correction amount KPG is increased.

Figure 13:
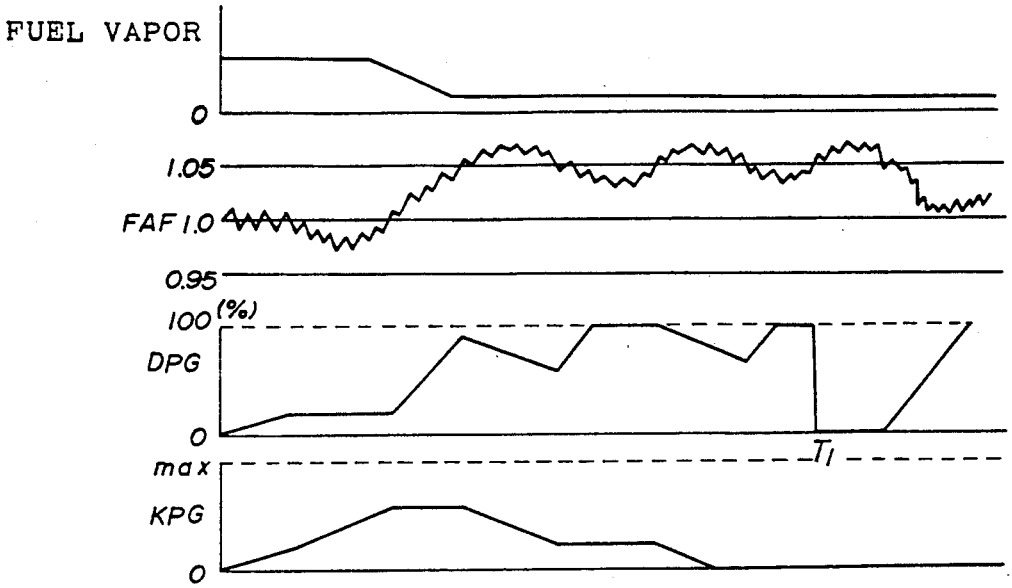
FIGS. 13 and 14 are timing charts for explaining the control operation of the evaporative fuel control apparatus shown in FIGS. 7A and 7B.

FIG. 13 shows a case in which the amount of fuel vapor contained in the charcoal canister 42 is small and only a small amount of fuel vapor is purged to the intake passage 11. As shown in a time chart in FIG. 13, the duty factor DPG and the purge correction amount KPG are varied in response to the feedback correction factor FAF which is changed as time elapses as shown in FIG. 13. The amount of fuel vapor purged is gradually decreased in accordance with the changes of DPG and KPG. It should be noted that the duty factor DPG is set to zero and the purging of fuel vapor is stopped at a time T1, indicated in FIG. 13, when the value of the FAF exceeds 1.05 after the purge correction amount KPG is equal to zero.

Figure 14:
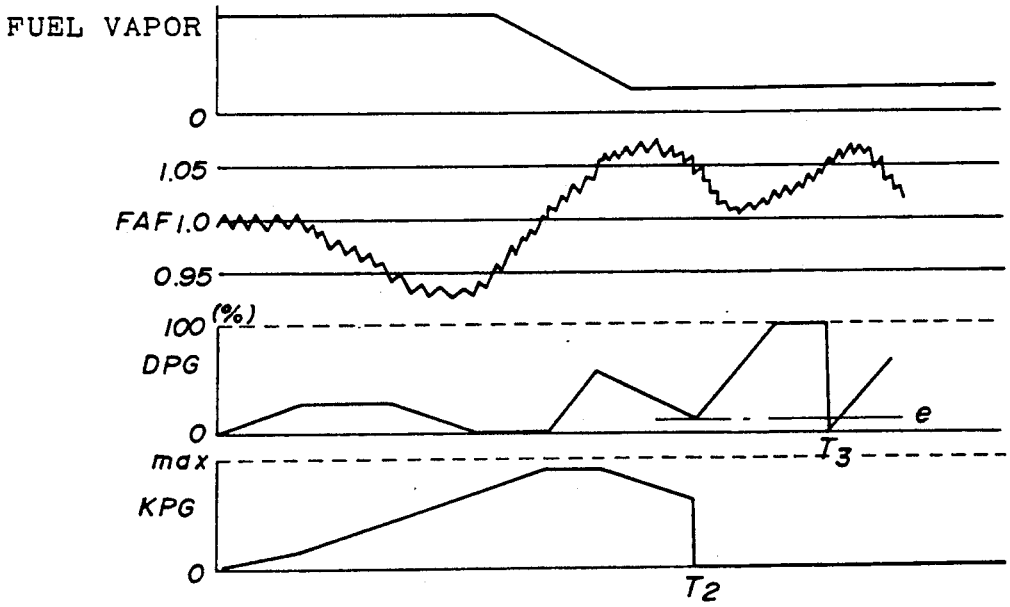

FIG. 14 shows a case in which the amount of fuel vapor contained in the charcoal canister 42 is great and much fuel vapor is purged to the intake system. As shown in a time chart in FIG. 14, the duty factor DPG and the purge correction amount KPG are varied in response to the feedback correction factor FAF which is changed as time elapses as shown in FIG. 14. The amount of fuel vapor purged is gradually decreased in accordance with the changes of DPG and KPG. It should be noted that the purge correction amount KPG is set to zero at a time T2 when the duty factor DPG is below the predetermined value "e" with the feedback correction factor FAF being greater than 1.05. It should also be noted that, after KPG is set to zero, the duty factor DPG is set to zero and the purging of fuel vapor is stopped at a time T3 when the feedback correction factor FAF exceeds 1.05.

According to the present invention, the duty factor DPG of the signal supplied to the VSV 43 is corrected suitably in response to the variations of purge correction amount KPG. When the air-fuel ratio fluctuates due to an excessive correction amount to correct the duty factor DPG, the duty factor DPG is adjusted so as to reduce such an excessive correction amount. When the fluctuation of the air-fuel ratio is due to an excessive correction amount to correct the purge correction amount KPG, the purge correction amount KPG is controlled so as to reduce such an excessive correction amount. For example, when the air fuel mixture is lean and the concentration of fuel vapor is small, the amount of fuel vapor purged is reduced to make the air fuel mixture rich in view of the stoichiometric air-fuel ratio. Therefore, it is possible to maintain the air fuel mixture accurately to the stoichiometric value.

In addition, the VSV valve control routine as shown in FIG. 3 is executed only when the idle switch is turned ON. When the idle switch is turned OFF, this routine is not executed, and in such a case, the duty factor DPG is determined from the engine speed NE and the flow rate of intake air, with reference to a predetermined map describing a relationship between the engine speed and the intake air flow rate. In the present embodiment of the evaporative fuel control apparatus, when the intake air flow rate is relatively large, the purge correction calculation is not performed and only the calculation of the purge correction amount is performed. However, the present invention is not limited to the above described embodiment, and it is a matter of course that, even when the idle switch is turned off, both the VSV valve control routine and the purge correction amount calculation routine can be executed.

As described above, the evaporative fuel control apparatus according to the present invention can convergently maintain the air fuel mixture invariably at the stoichiometric air-fuel ratio even when the air fuel mixture is very lean and the fuel vapor concentration is very low, and the evaporative fuel control apparatus of the present invention is useful for practical purposes Further, the present invention is not limited to the above described embodiments, and variations and modifications may be made without departing from the scope of the present invention.

What is claimed is:

1. An evaporative fuel control apparatus comprising:

detection means for detecting operating conditions of an internal combustion engine and for supplying signals indicative of said operating conditions;

purge means for controlling a flow of fuel vapor from a fuel tank into an intake passage of the internal combustion engine;

calculation means for calculating a fuel injection amount in response to said signals supplied by said detection means;

first injection control means for varying a feedback correction factor of an air-fuel ratio of an air fuel mixture, in response to said signals supplied by said detection means, so as to maintain the air-fuel ratio at a stoichiometric value, and for correcting the fuel injection amount which is calculated by the calculation means with the feedback correction factor thus varied;

second injection control means for correcting the fuel injection amount being calculated by the calculation means, in response to a concentration of fuel vapor in intake mixture which is determined from the feedback correction factor varied by the first injection control means; and purge correction means for correcting a purging amount of fuel vapor being fed by the purge means into the intake passage, in response to the fuel vapor concentration determined from the feedback correction factor.

2. The apparatus as claimed in claim 1, wherein said purge correction means adjusts a duty factor of a second signal, supplied to said purge means, in response to the fuel vapor concentration in the intake mixture, so that the purging amount of fuel vapor is changed by a purge correction amount, said fuel injection amount being calculated by said calculation means from said purge correction amount.

3. The apparatus as claimed in claim 1, wherein said purge means is made of an electric vacuum switching valve.

4. The apparatus as claimed in claim 1, wherein said detection means comprises an oxygen sensor mounted in an exhaust passage of the internal combustion engine for detecting a concentration of oxygen in exhaust gas and for supplying a signal indicative of said oxygen concentration, and a pressure sensor mounted downstream of a throttle position sensor in the intake passage for detecting an intake air pressure and for supplying a signal indicative of said intake air pressure.

5. The apparatus as claimed in claim 2, wherein said purge correction amount is decreased to increase the fuel injection amount when said feedback correction factor is greater than a high reference level which is preset at above 1.0, and said purge correction amount remains unchanged to prevent the fuel injection amount from being increased excessively when said feedback correction factor is greater than 1.0 and smaller than said high reference level.

6. The apparatus as claimed in claim 2, wherein said purge correction amount is increased and said duty factor is decreased to decrease the fuel injection amount when said feedback correction factor is smaller than a low reference level which is preset to below 1.0, and said purge correction amount is increased and said duty factor remains unchanged to decrease the fuel injection amount when said feedback correction factor is greater than said low reference level and smaller than 1.0.

7. The apparatus as claimed in claim 1, wherein said purging amount of fuel vapor corrected by said purge correction means is controlled in response to a correction amount by said second injection control means to correct the fuel injection amount, so that the fuel injection amount, calculated by said calculation means, is adjusted appropriately.

8. The apparatus as claimed in claim 7, wherein said purge correction means adjusts a duty factor of a second signal, supplied to said purge means, in response to said fuel vapor concentration, so that said purging amount of fuel vapor is corrected, said purging amount of fuel vapor changing by a purge correction amount, said fuel injection amount being calculated by said calculation means from said purge correction amount.

9. The apparatus as claimed in claim 8, wherein said purge correction amount remains unchanged when said feedback correction factor is greater than said high reference level and said duty factor is smaller than a predetermined level which is preset at slightly above zero, and said purge correction amount is decreased to increase the fuel injection amount when said duty factor is greater than said predetermined level and said feedback correction factor is greater than said high reference level.

10. The apparatus as claimed in claim 8, wherein said purge correction amount remains unchanged when said feedback correction factor is greater than 1.0 and smaller than said high reference level, and said purge correction amount is increased to decrease the fuel injection amount when said feedback correction factor is smaller than 1.0.

11. The apparatus as claimed in claim 7, wherein said detection means comprises an oxygen sensor mounted in an exhaust passage of the internal combustion engine for detecting a concentration of oxygen in exhaust gas and for supplying a signal indicative of said oxygen concentration, and an air flow meter mounted upstream of a throttle position sensor in the intake passage for detecting an intake air flow rate and for supplying a signal indicative of the intake air flow rate.

12. The apparatus as claimed in claim 1, wherein a correction amount by the second injection control means to correct the fuel injection amount, calculated by said calculation means, is controlled in response to the purging amount of fuel vapor corrected by the purge correction means.

13. The apparatus as claimed in claim 12, wherein said purge correction means adjusts a duty factor of a second signal, supplied to said purge means, in response to said fuel vapor concentration, so that said purging amount of fuel vapor is corrected, said purging amount of fuel vapor changing by a purge correction amount, said fuel injection amount being calculated by said calculation means from said purge correction amount.

14. The apparatus as claimed in claim 13, wherein said purge correction amount remains unchanged when said feedback correction factor is greater than said high reference level and said duty factor is smaller than a predetermined level which is preset at slightly above zero, and said purge correction amount is decreased to increase the fuel injection amount when said duty factor is greater than said predetermined level and said feedback correction factor is greater than said high reference level.

15. The apparatus as claimed in claim 13, wherein said purge correction amount remains unchanged when said feedback correction factor is greater than 1.0 and smaller than said high reference level, and said purge correction amount is increased to decrease the fuel injection amount when said feedback correction factor is smaller than 1.0.

* * * * *